US012203713B2

(12) United States Patent
Katakura et al.

(10) Patent No.: US 12,203,713 B2
(45) Date of Patent: Jan. 21, 2025

(54) CLIP FOR TUBE ELEMENT

(71) Applicant: T.RAD CO., LTD., Tokyo (JP)

(72) Inventors: Shotaro Katakura, Tokyo (JP); Wataru Kojima, Tokyo (JP); Koichi Akisawa, Tokyo (JP); Masato Murayama, Tokyo (JP)

(73) Assignee: T.RAD CO., LTD., Tokyo (JP)

( * ) Notice: Subject to any disclaimer, the term of this patent is extended or adjusted under 35 U.S.C. 154(b) by 215 days.

(21) Appl. No.: 18/010,708

(22) PCT Filed: Jun. 23, 2021

(86) PCT No.: PCT/JP2021/024887
§ 371 (c)(1),
(2) Date: Dec. 15, 2022

(87) PCT Pub. No.: WO2021/261604
PCT Pub. Date: Dec. 30, 2021

(65) Prior Publication Data

US 2023/0243604 A1 Aug. 3, 2023

(30) Foreign Application Priority Data

Jun. 26, 2020 (JP) ..... 2020-110962

(51) Int. Cl.
*F28F 9/00* (2006.01)
*F28F 1/30* (2006.01)
*F28F 9/013* (2006.01)

(52) U.S. Cl.
CPC ..... *F28F 9/0138* (2013.01); *F28F 1/30* (2013.01)

(58) Field of Classification Search
USPC ..... 165/67
See application file for complete search history.

(56) References Cited

U.S. PATENT DOCUMENTS

| | | | | |
|---|---|---|---|---|
| 4,197,906 | A * | 4/1980 | Leech | F16B 2/241 403/201 |
| 5,697,431 | A * | 12/1997 | Nagasaka | F28F 9/002 165/149 |
| 6,357,513 | B1 | 3/2002 | Janezich et al. | |
| 2020/0064073 | A1 * | 2/2020 | Tan | F28D 1/05316 |

FOREIGN PATENT DOCUMENTS

| | | | |
|---|---|---|---|
| JP | 54785 | | 4/1980 |
| JP | 55-107899 | A | 8/1980 |
| JP | 7-22264 | U | 4/1995 |
| JP | 2008-185308 | A | 8/2008 |
| JP | 2012-122649 | A | 6/2012 |

* cited by examiner

*Primary Examiner* — Davis D Hwu
(74) *Attorney, Agent, or Firm* — Norris McLaughlin, P.A.

(57) ABSTRACT

In a clip for holding a tube element, a first fitting part is provided on one side surface of the clip, and a second fitting part is provided on the other side surface. A back surface holding part is provided on an open side of the clip, and a front surface holding part is provided on an unopened side. Furthermore, a tongue piece is provided between the back surface holding part and the front surface holding part.

11 Claims, 13 Drawing Sheets

CLIP FOR TUBE ELEMENT

TECHNICAL FIELD

The present invention relates to a heat exchanger having an assembly of a detachable tube and a fin, which is found in engine cooling systems for construction machinery, and relates to a clip for holding a tube element constituted of the assembly of the tube and fin.

BACKGROUND ART

There is an article in which, for tube elements constituted of an assembly of a flat tube and a corrugated fin, every single element thereof is freely detachable from a header for repair or replacement.

Further, there is described in Patent Literature 1 below that clips are mounted on plural tube elements and these clips are coupled each other to hold the tube element.

FIGS. 11A, 11B to FIG. 13 show a clip 13 for a conventional tube element 4 described in Patent Literature 1.

Further, FIG. 11A is a plan view thereof, and FIG. 11B is a front view. Moreover, FIGS. 12A-12C are mounting explanatory views of the clip 13, in which FIG. 12A is a plan view thereof, FIG. 12B is a front view, and FIG. 3C is a side view. Furthermore, FIG. 13 is a plan view showing a state in which many clips 13 are arranged in parallel.

The clip 13 is constituted of a resin molded body and has a channel-shaped first fitting part 13*a* on one side thereof, and a second fitting part 13*b* matching with it is formed on the other side, as shown in FIG. 11. Moreover, a convex part 13*f* is provided in a protruding state on a front surface side of the clip 13, a front surface holding part 13*e* with a U-shaped cross-section is formed between the first fitting part 13*a* and the second fitting part 13*b*, and a tongue piece part 13*c* is provided inside the front surface holding part 13*e*. Furthermore, an abutting surface 13*g* is formed on one end of the first fitting part 13*a*.

This clip 13 holds the tube element 4 constituted of a combination of a flat tube 2 and a corrugated fin 3 in a manner as shown in FIGS. 12A to FIG. 12C. In other words, the front surface holding part 13*e* formed in a U-shape holds a front surface of the tube element 4, and the tongue piece part 13*c* is inserted between neighboring bent parts 3*a* of the corrugated fin 3.

In an instance of this clip 13, as shown in FIG. 13 subsequently, many clips 13 are coupled each other in an X direction and Y direction in FIG. 13, and these are arranged zigzag in a plane and connected each other.

CITATION LIST

Patent Literature

PTL 1: U.S. Pat. No. 6,357,513

SUMMARY OF INVENTION

Technical Problem

In the conventional type clip 13, the tube element 4 is housed in the front surface holding part 13*e* with a U-shaped cross-section in FIGS. 12A-12C. In this instance, the tube element 4 might move to an open end of the front surface holding part 13*e* and fall off from it.

Furthermore, there has been a disadvantage that, when the tongue piece part 13*c* provided in the U-shape is inserted between bent parts 3*a* of the corrugated fin 3, this work cannot be performed smoothly.

Moreover, there has been a disadvantage that, when many clips 13 are coupled in the Y direction in FIG. 13, these clips 13 tend to be separated from each other.

Thus, the present invention is directed to eliminate these disadvantages.

Solution to Problem

The present invention according to a first aspect thereof is a clip for tube element, including:

- a flat tube 2 having a pair of even surfaces 1 facing each other;
- a corrugated fin 3 formed in a waveform;
- a plurality of tube elements 4 in which a bent part 3*a* on one side of the wave of the corrugated fin 3 is joined with the even surface 1 orthogonally to an axis line Z of the flat tube 2 wherein;
- the clip for coupling these tube elements 4 each other includes;
- in an instance of defining a ridgeline direction of the bent part 3*a* which is orthogonal to the axis line Z as Y, while defining a direction orthogonal to the Y and Z as X;
- a first fitting part 5 in which a groove bottom is formed in a dovetail groove shape in the Z direction on one side surface in the X direction, and a convex second fitting part 6 that is formed on the other side surface and has a horizontal section fittable to the first fitting part 5;
- a back surface holding part 7 in which one side in the Y direction is opened, the part 7 holding one end part orthogonal to a ridgeline direction of the bent part 3*a* of the corrugated fin 3 at an end edge of an inner wall surface thereof to have a hook-shaped horizontal section;
- a front surface holding part 8 with a U-shaped horizontal section that holds the other end part of the corrugated fin 3, on an unopened side; and
- a tongue piece 9 that is formed between the back surface holding part 7 and the front surface holding part 8 and is inserted between neighboring waves of the corrugated fin 3.

The present invention according to a second aspect is the clip for tube element according to the first aspect, wherein;

- the clip for tube element is provided with a third fitting part 10 with a groove bottom formed in a dovetail groove shape in the Z direction on a side surface of an outside in the Y direction of the front surface holding part 8, and a fourth fitting part 11 that is provided in a protruding state on a side surface of an outside in the Y direction of the back surface holding part 7 and is fittable to the third fitting part 10.

The present invention according to a third aspect is the clip for tube element according to the first or second aspect, wherein;

- width in the X direction of the tongue piece 9 gradually enlarges from the back surface holding part 7 toward the front surface holding part 8.

The present invention according to a fourth aspect is the clip for tube element according to the first or second aspect, wherein;

- the maximum value of width in the X direction of the tongue piece 9 ranges from 30 to 70% of height of the corrugated fin 3.

The present invention according to the fifth aspect is the clip for tube element according to any of the second to fourth aspects, wherein;

the third fitting part 10 is constituted of a first protruding part 10*a* that lies on a second fitting part 6 side of an outside of the front surface holding part 8 and protrudes in the Y direction, and a second protruding part 10*b* that lies on a first fitting part 5 side of an outside of the front surface holding part 8 and protrudes in the Y direction; and, in a state in which the fourth fitting part 11 of a neighboring clip has been fitted in the Y direction to the third fitting part 10, an end surface of the first protruding part 10*a* or an end surface of the second protruding part 10*b* supports one end part in a longitudinal direction of a horizontal section of the flat tube 2 of the tube element 4 held with the clip neighboring in the Y direction.

Advantageous Effects of Invention

In the first aspect of the invention, the first fitting part 5 in a dovetail groove shape in the Z direction is formed on one side surface in the X direction of the clip 12, with the convex second fitting part 6 fittable to it is possessed on the other side surface. Hereby, clips 12 can be coupled each other in the X direction. In addition, since the first fitting part 5 is formed in a dovetail groove shape, neighboring clips 12 have no risk of separation from each other in the X direction.

Moreover, the back surface holding part 7 that holds one end part of the corrugated fin 3 to have a hook-shaped horizontal section is possessed on a side surface in the Y direction, and the front surface holding part 8 that holds the other end part of the corrugated fin 3 and has a U-shaped horizontal section is possessed on the other side surface. Hereby, the tube element 4 can be embraced in an inner part of the clip 12. In addition, since the back surface holding part 7 is formed in a hook shape, the tube element 4 can be prevented from fall-off in the Y direction.

Furthermore, the tongue piece 9 to be inserted between waves of the corrugated fin 3 is possessed between the back surface holding part 7 and the front surface holding part 8. Hereby, the tube element 4 held with the clip 12 is prevented from fall-off in the Z direction.

The second aspect of the invention includes the third fitting part 10 whose groove bottom is formed in a dovetail groove shape in the Z direction on a side surface of an outside in the Y direction of the front surface holding part 8, and the fourth fitting part 11, which is provided in a protruding state and is fittable to the third fitting part 10, on a side surface of an outside in the Y direction of the back surface holding part 7.

Hereby, clips 12 can be coupled with each other in the Y direction. In addition, since the third fitting part 10 is formed in a dovetail groove shape, prevention of fall-off is made possible in the Y direction.

In the third aspect of the invention, the width of the tongue piece 9 is formed to gradually enlarge from the back surface holding part 7 toward the front surface holding part 8.

Hereby, the tongue piece 9 can be smoothly inserted between waves of the corrugated fin 3.

In the fourth aspect of the invention, the maximum value of the width of the tongue piece 9 ranges from 30 to 70% of the height W of the corrugated fin 3.

Hereby, the clip 12 is prevented from fall-off from the corrugated fin 3 in the Z direction, and, in addition, restraint on the corrugated fin 3 and the flat tube 2 in the Z direction due to the clip 12 is released to suppress generation of thermal stress due to the restraint.

In the fifth aspect of the invention, in a state in which the fourth fitting part 11 of a neighboring clip has been fitted in the Y direction to the third fitting part 10, an end surface of the first protruding part 10*a* or an end surface of the second protruding part 10*b* forming the third fitting part 10 supports one end part in the longitudinal direction of the horizontal section of the flat tube 2 of the tube element 4 held with the clip neighboring in the Y direction.

Due to this constitution, support in the Y direction on the tube element 4 lying at the end part in the X direction of a coupled tube element group is more secured.

BRIEF DESCRIPTION OF DRAWINGS

FIGS. 1A-1C show the clip 12 of the present invention, in which FIG. 1A is a perspective view thereof, FIG. 1B is a plan view, and FIG. 1C is a side view.

FIGS. 2A, 2B show amounting explanatory view of the clip 12 and the tube element 4, in which FIG. 2A shows a state before the mounting, and FIG. 2B shows a state after the mounting.

FIGS. 3A, 3B show a use explanatory view of the clip 12, in which FIG. 3A is a plan view thereof, and FIG. 3B is a view of FIG. 3A seen along a B-B arrow.

FIGS. 12A-12C show a mounting state of the clip 13 and the tube element 4, in which FIG. 12A is a plan view thereof, FIG. 12B is a front view, and FIG. 12C is a side view.

DESCRIPTION OF EMBODIMENTS

Next, embodiments of the present invention will be explained based on the drawings.

Figure 1A:
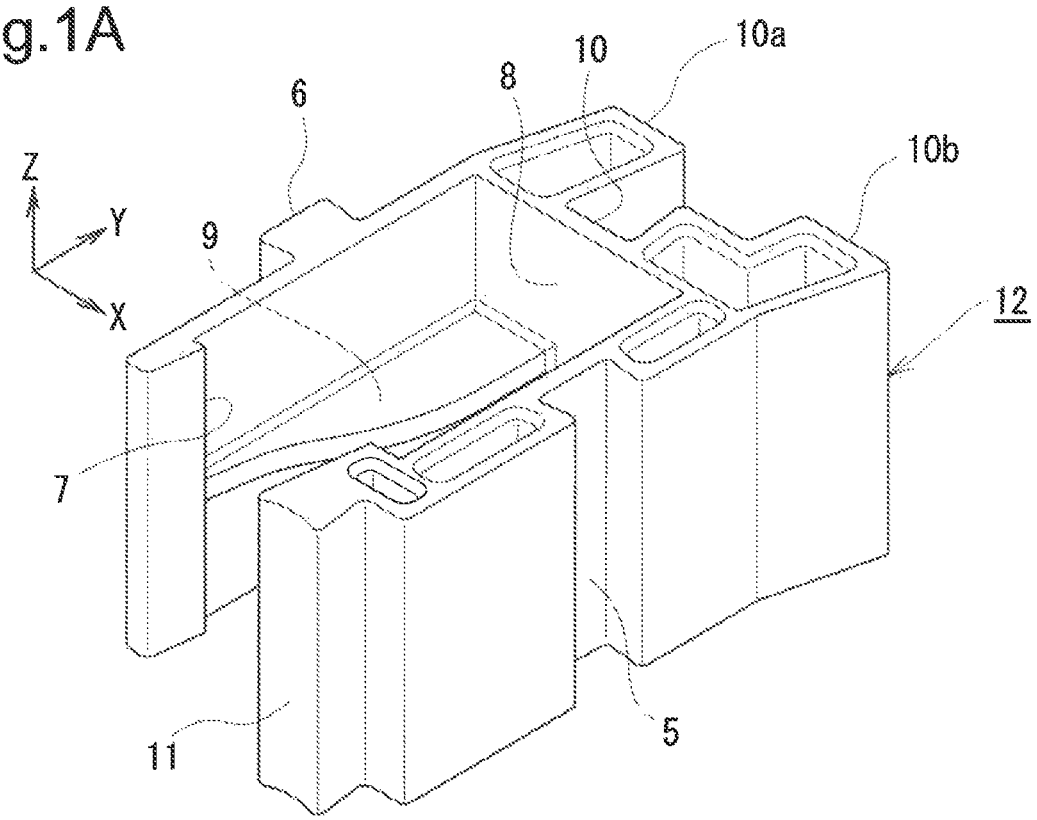
Figure 1B:
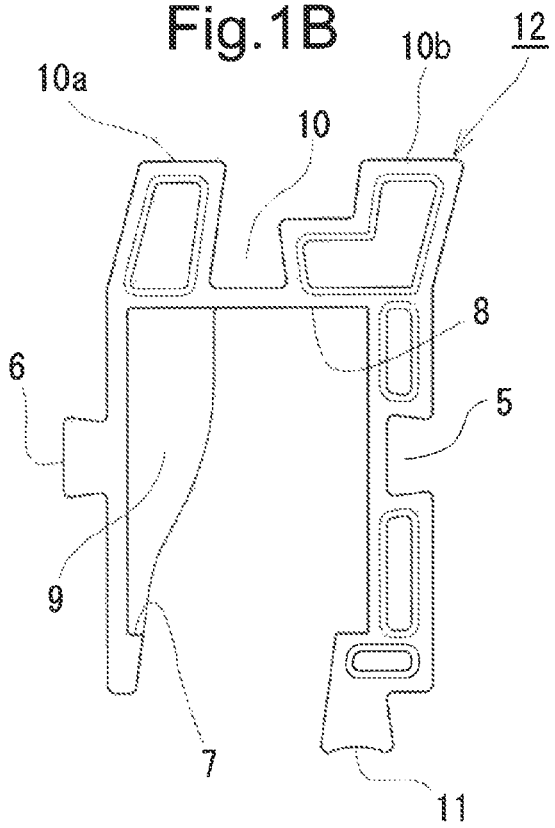
Figure 1C:
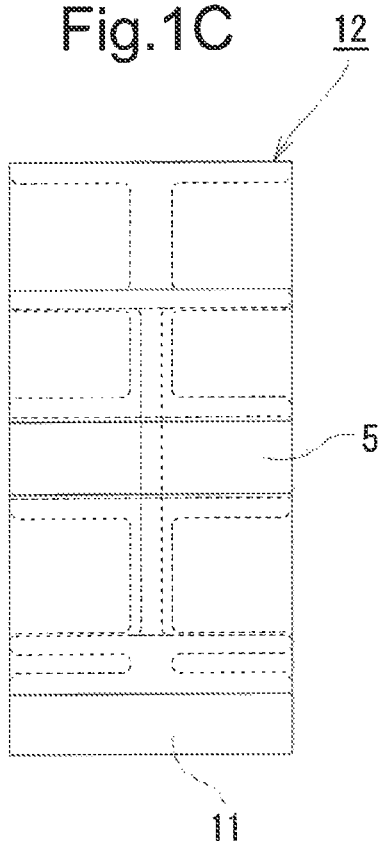
Figure 2A:
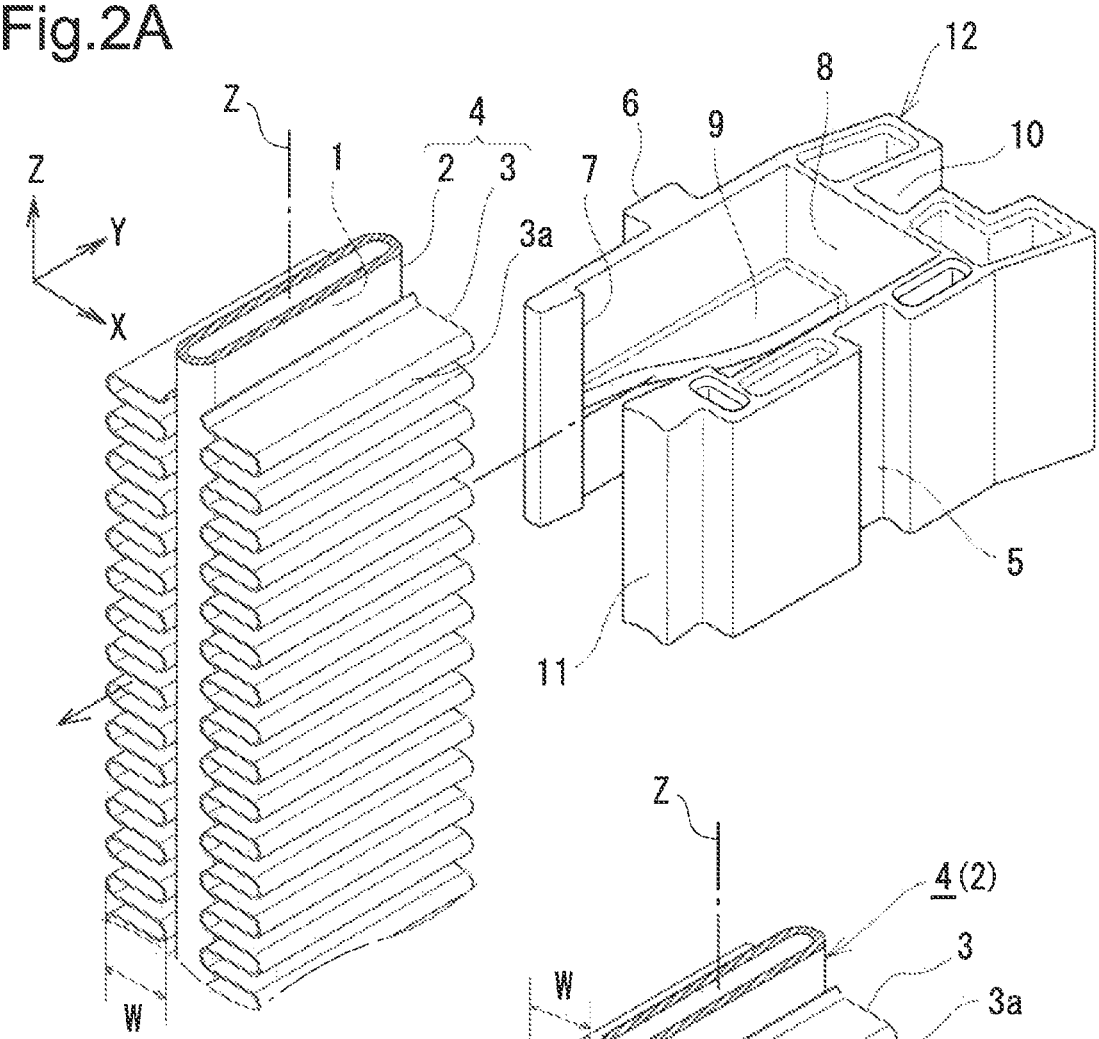
Figure 2B:
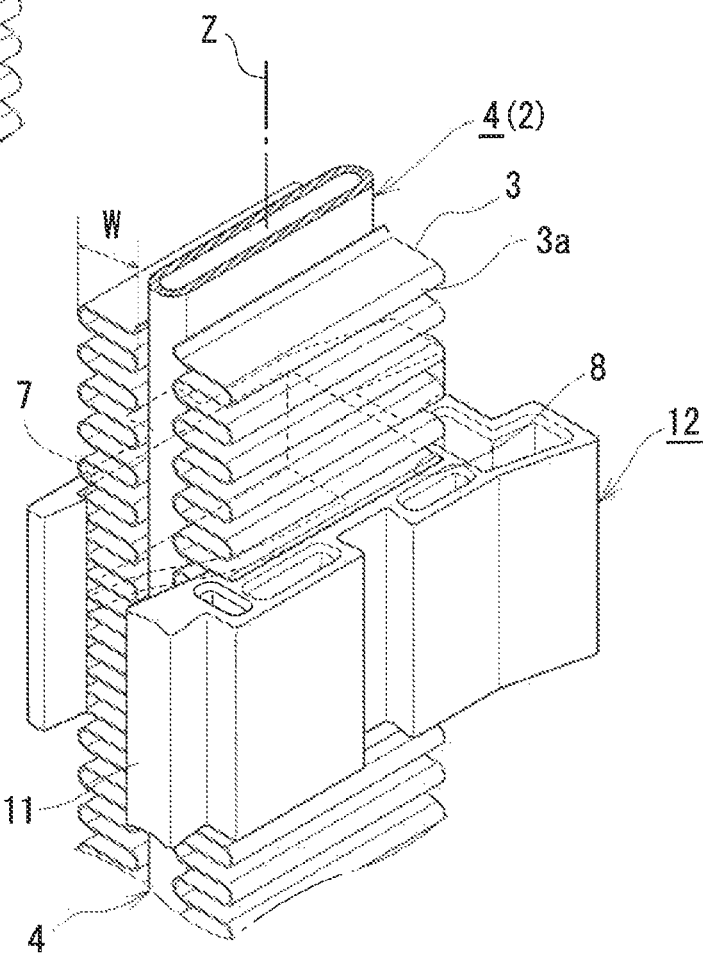

FIGS. 1A, 1B show as a perspective view, as FIG. 1B a plan view and as FIG. 1C a side view of the clip 12 of the present invention, and FIGS. 2A, 2B are explanatory views when the clip 12 is mounted on the tube element 4, in which FIG. 2A is a perspective view showing a state before the mounting, and FIG. 2B is a perspective view showing a state after the mounting.

This clip 12 is constituted of a resin member as an example, and is constituted of one in which the wall surface thereof can deform elastically in part. This clip 12 embraces an outer circumference of the tube element 4 constituted of a joined body of the flat tube 2 and the corrugated fin 3, as shown in FIG. 2B.

The tube element 4 in which the clip 12 of the present invention is used is constituted of a pair of even surfaces 1, the flat tube 2 formed of side surfaces tubularly linking these even surfaces 1, and the corrugated fin 3 formed in a wavy pattern. Specifically, as shown in FIG. 2A, the bent part 3*a* on one side of the wavy pattern of the corrugated fin 3 is brazed and fixed integrally to an outside of the pair of even surfaces 1, orthogonally to an axis line Z (a direction same as the direction of the axis line Z is defined as the Z direction) connecting openings of the flat tube 2.

Here, a direction that is orthogonal to the Z direction, and along which the ridgeline of the bent part 3*a* of the corrugated fin 3 runs, is defined as the Y direction. Moreover, a direction orthogonal to these Z direction and Y direction is defined as the X direction.

Meanwhile, both end parts in the Z direction of the flat tube 1 constituting the tube element 4 can be formed in a cylindrical shape.

Relative to the tube element 4, the clip 12 has a pair of side surfaces facing each other in the X direction, and the first fitting part 5 is formed on an outside of one side surface, and the convex second fitting part 6 fittable to the first fitting part 5 is formed on an outside of the other side surface. In the first fitting part 5, the horizontal section thereof (surface that is perpendicular to the Z direction) is formed in a dovetail groove shape, and as shown in FIG. 1C, the groove extends in the Z direction. The width of the groove bottom is formed slightly wider than the width of the opening of the groove, as shown in FIG. 1B. In the second fitting part 6, the convex tip side is wider than the root side.

Next, one side in the Y direction of the clip 12 is opened.

At a tip inside the side surface on which the second fitting part 6 is formed, the back surface holding part 7 with a hook-shaped horizontal section is formed. In addition, at a tip edge inside the side surface on which the first fitting part 5 is formed, too, the back surface holding part 7 with a hook-shaped horizontal section is formed. Moreover, the other side in the Y direction is closed with a wall surface, and the front surface holding part 8 with a horizontal section formed in a U-shape is possessed with a pair of side surfaces that are linked integrally to the wall surface and face each other in the X direction.

Inside the side surface on which the second fitting part 6 is formed, the tongue piece 9 is formed between the back surface holding part 7 and the front surface holding part 8. This tongue piece 9 is inserted into the bent part 3*a* side of the corrugated fin 3 not linked to the even surface 1.

As shown in FIG. 1B, this tongue piece 9 will have a suitable shape for smooth insertion when it is formed so that the width enlarges gradually from the back surface holding part 7 toward the front surface holding part 8. The thickness of the tongue piece 9 is preferably set to be slightly smaller than the space of pitches between bent parts 3*a* of the corrugated fin 3.

The tongue piece 9 may have been formed inside a side surface on which the first fitting part 5 has been formed.

As shown in FIG. 1B, the fourth fitting part 11 may be formed with a stepped horizontal section at the tip on the opened side of the clip 12. In this instance, the third fitting part 10 fittable to the fourth fitting part 11 is previously formed on the outer surface side of the wall surface of the front surface holding part 8. In the third fitting part 10, the horizontal section thereof has been formed in a dovetail groove shape and the groove is provided along the Z direction, similarly to the first fitting part 5.

In the clip 12 of the present invention, the tube element 4 is inserted from the back surface holding part 7 side of the clip 12, as shown in FIG. 2A. At this time, the front surface holding part 8 of the clip 12 deforms elastically in part, and the back surface holding part 7 side thereof broadens outwardly. Then, one end in the Y direction of the corrugated fin 3 of the tube element 4 abuts on the front surface holding part 8, and the other end side abuts on, or faces via a slight gap, the back surface holding part 7.

At this time, the tongue piece 9 is inserted into the gap between bent parts 3*a* of the corrugated fin 3 on one side. At this insertion, the tongue piece 9 is smoothly inserted between bent parts 3*a* because the width on the back surface holding part 7 side is narrowed in this example.

Due to this tongue piece 9, the clip 12 is prevented from fall-off in the Z direction from the corrugated fin 3.

Figure 3A:
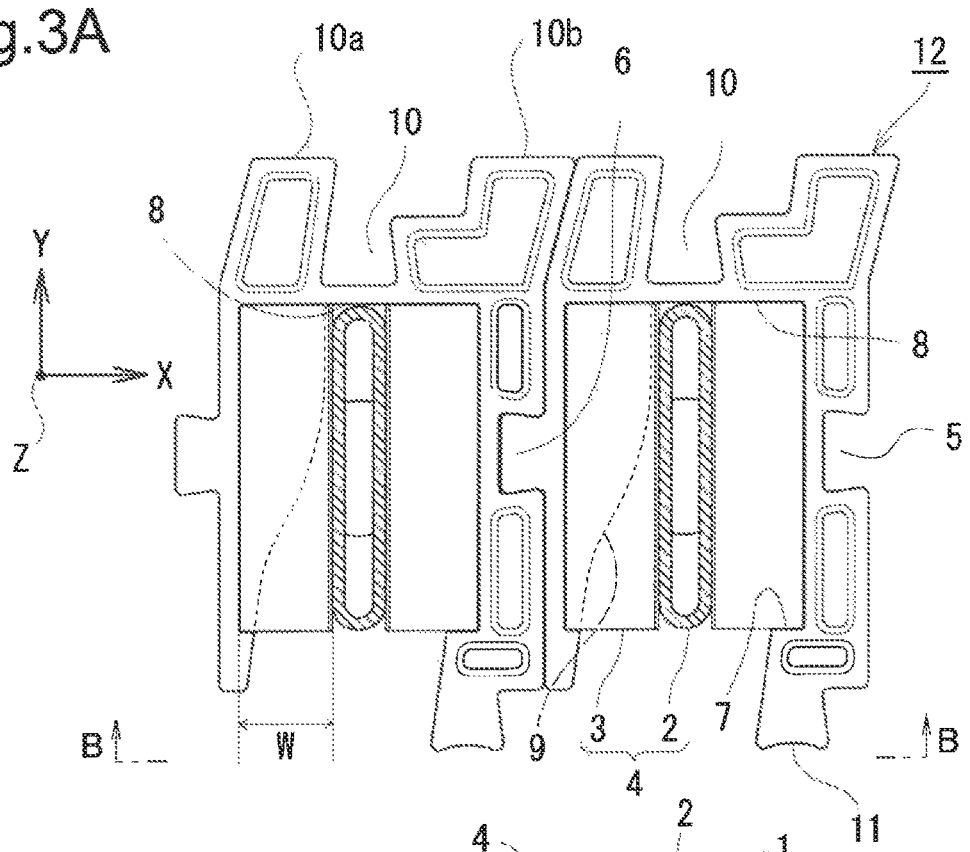
Figure 3B:
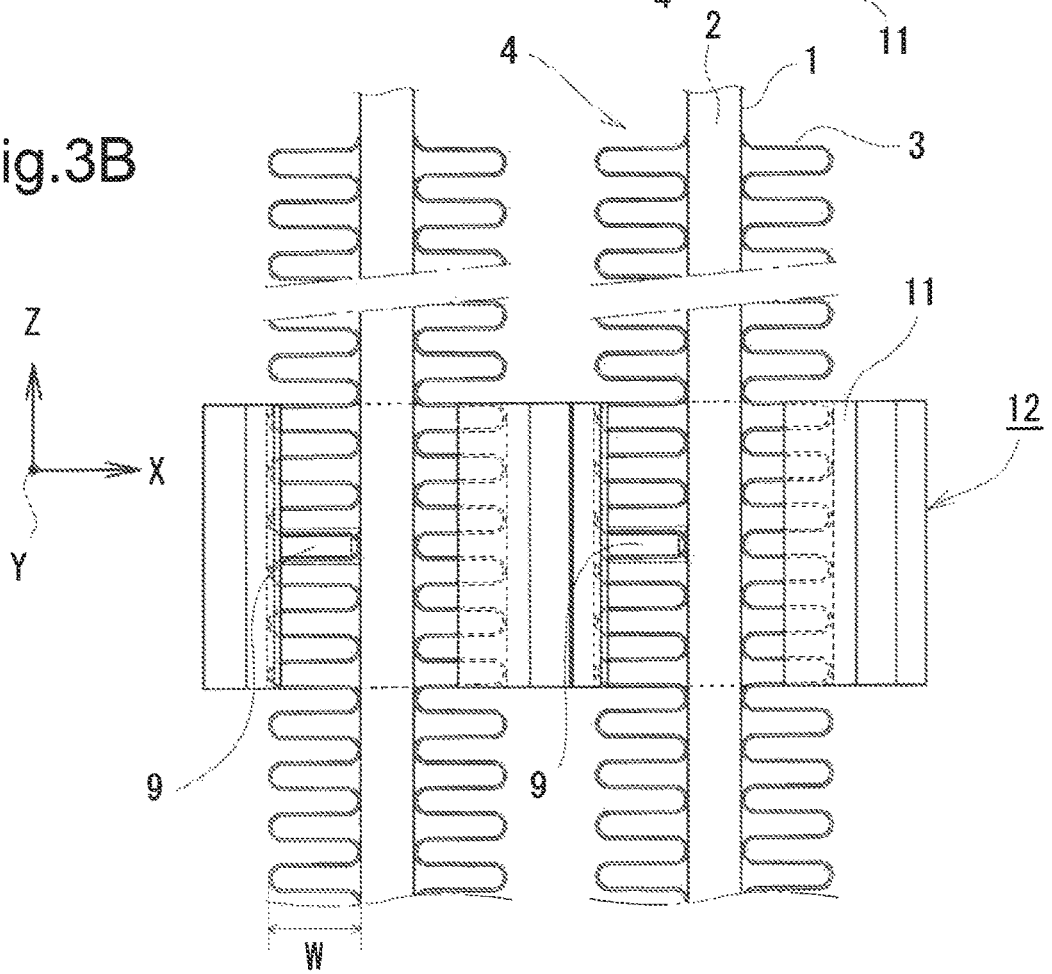

Going back to the beginning, FIG. 3A is a plan view and FIG. 3B a front view, showing the use state of the clip 12 of the present invention. In FIGS. 3A, 3B, in an instance where a pair of clips 12 are arranged in parallel in the X direction, the second fitting part 6 and the first fitting part 5 of neighboring clips 12 are fitted to each other, and are prevented from fall-off in the X direction due to the dovetail groove of the first fitting part 5.

Figure 4:
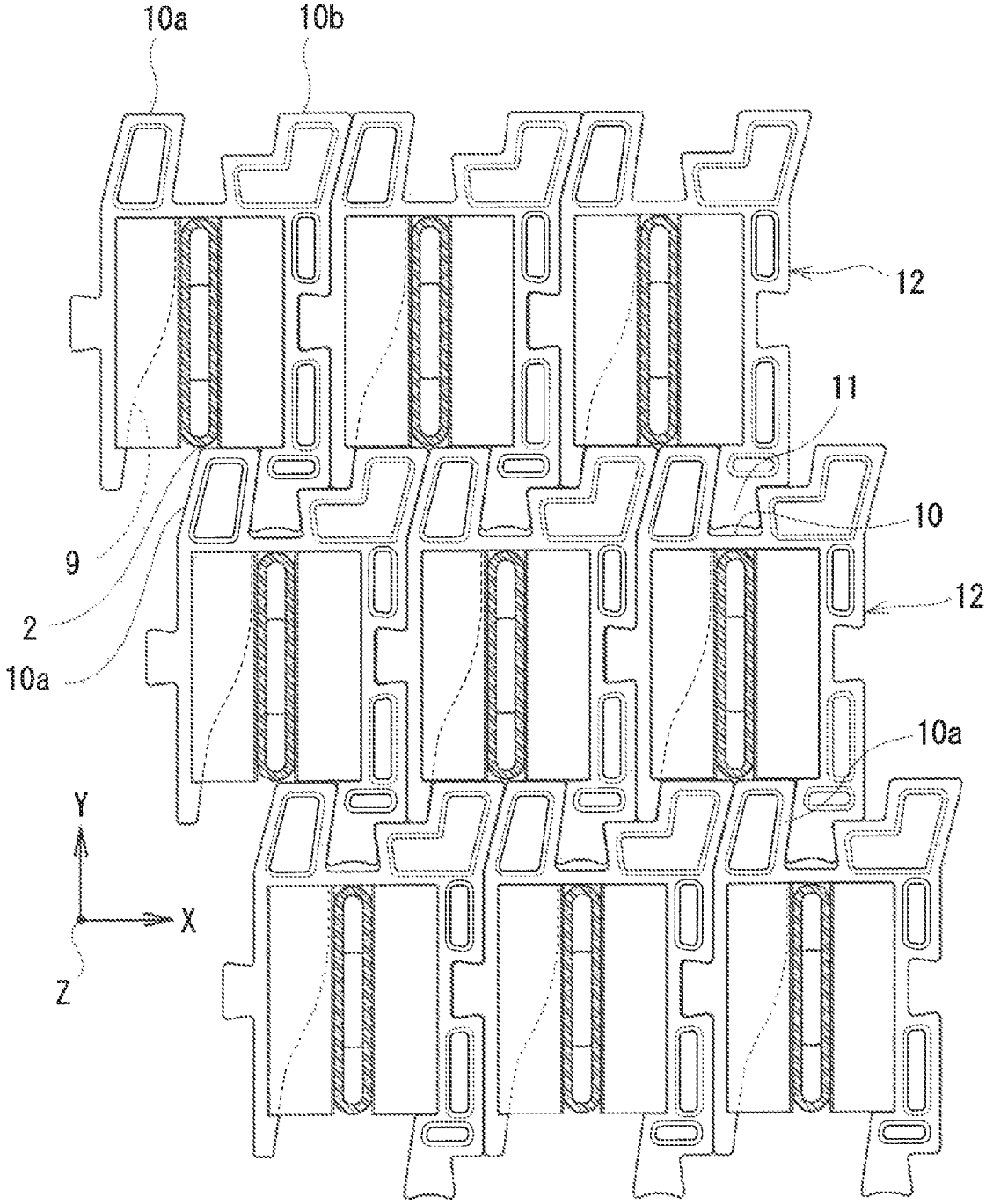
FIG. 4 shows a plan view showing amounting state of many clips 12.
Figure 5:
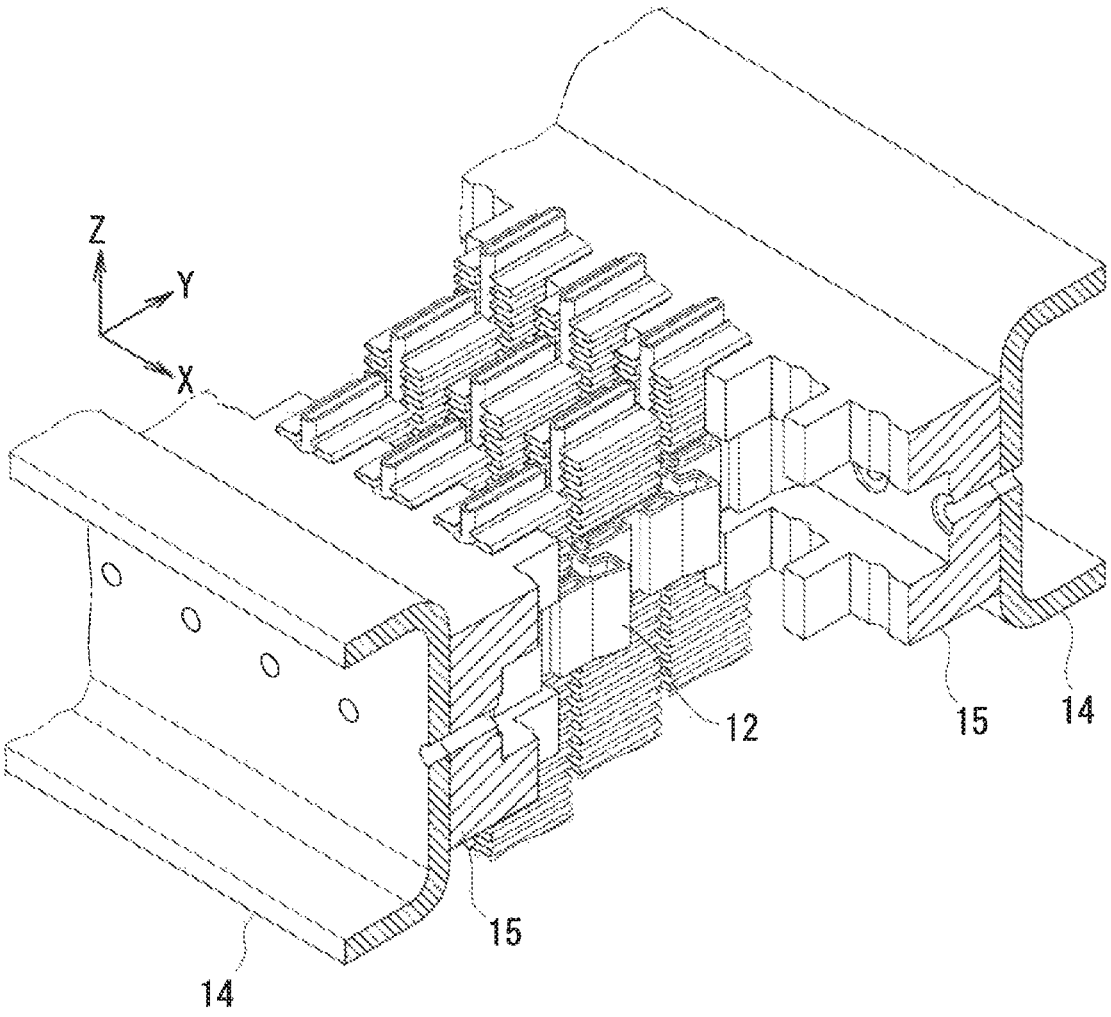
FIG. 5 shows a perspective view showing a mounting state of the clip 12.
Figure 6A:
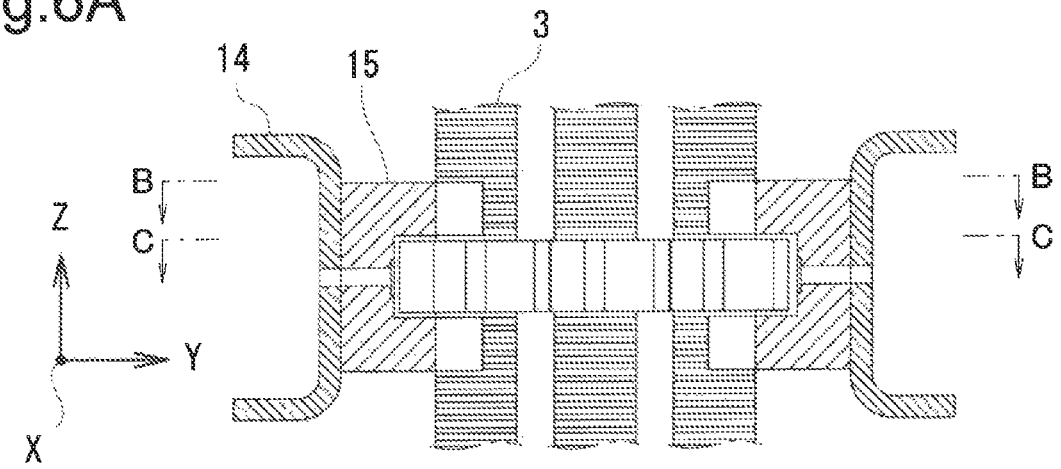
FIGS. 6A-6C show as FIG. 6A a vertical cross-sectional view showing a mounting state of the clip 12, as FIG. 6B a B-B part cross-sectional view, and as FIG. 6C a C-C cross-sectional view.
Figure 6B:
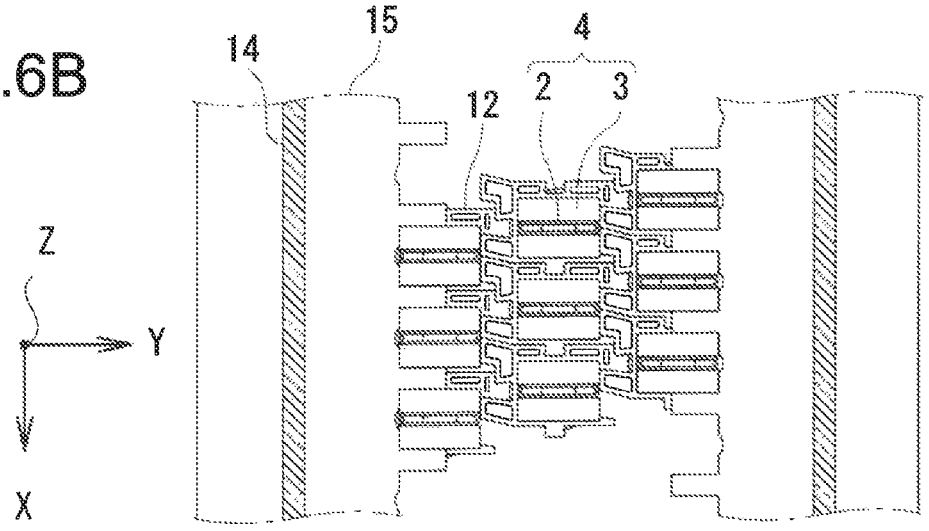
Figure 6C:
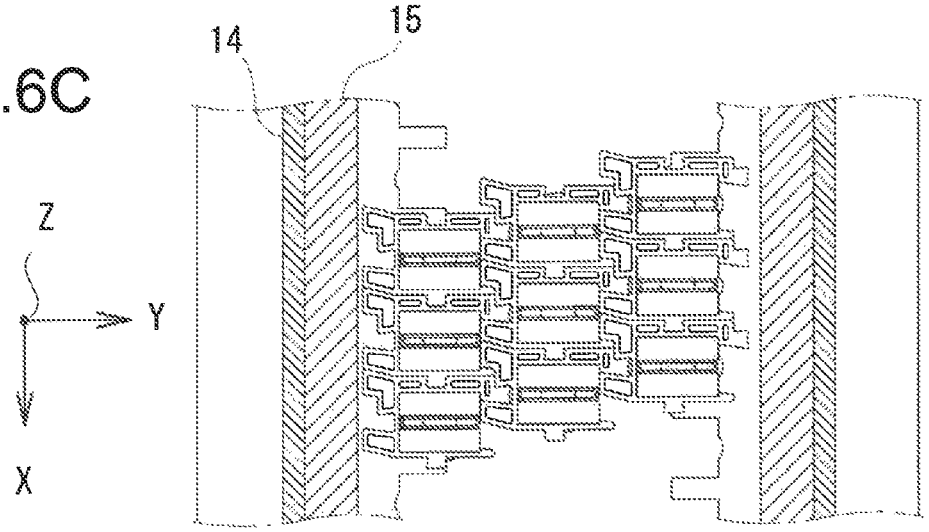

FIG. 4 is a plan view showing a state in which many clips 12 are coupled in the X direction and the Y direction in a state in which the tube element 4 is held. In FIG. 4, when many clips 12 are arranged in parallel in the Y direction, the fourth fitting part 11 on one side is fitted to the other third fitting part 10 arranged in parallel in the Y direction. In this instance, the third fitting part 10 keeps the fitted state with the fourth fitting part 11 because it is formed in a dovetail groove shape.

Meanwhile, when the fourth fitting part 11 is fitted to the third fitting part 10, the groove in the third fitting part 10 of the partner clip 12 deforms elastically and broadens outwardly.

The third fitting part 10 is formed between the first protruding part 10*a*, which lies on the second fitting part 6 side outside the front surface holding part 8 and protrudes in the Y direction, and the second protruding part 10*b*, which lies on the first fitting part 5 side outside the front surface holding part 8 and protrudes in the Y direction.

As shown in FIG. 4, in the state in which the fourth fitting part 11 of a clip neighboring in the Y direction to the third fitting part 10 has been fitted, the end surface of the first protruding part 10*a* and the end surface of the second protruding part 10*b* are constituted to support one end part in the longitudinal direction of the flat tube 2 of the tube element 4 held with a clip neighboring in the Y direction. Due to the construction of this end surface of the first protruding part 10*a* and the end surface of the second protruding part 10*b*, around a half width in a lateral direction of the horizontal section of the flat tube 2 can be supported.

The length in the longitudinal direction of the flat tube 2 of the tube element 4 is set preferably to be the same as length from one end to the other end in the Y direction of the corrugated fin 3.

Figure 7A:
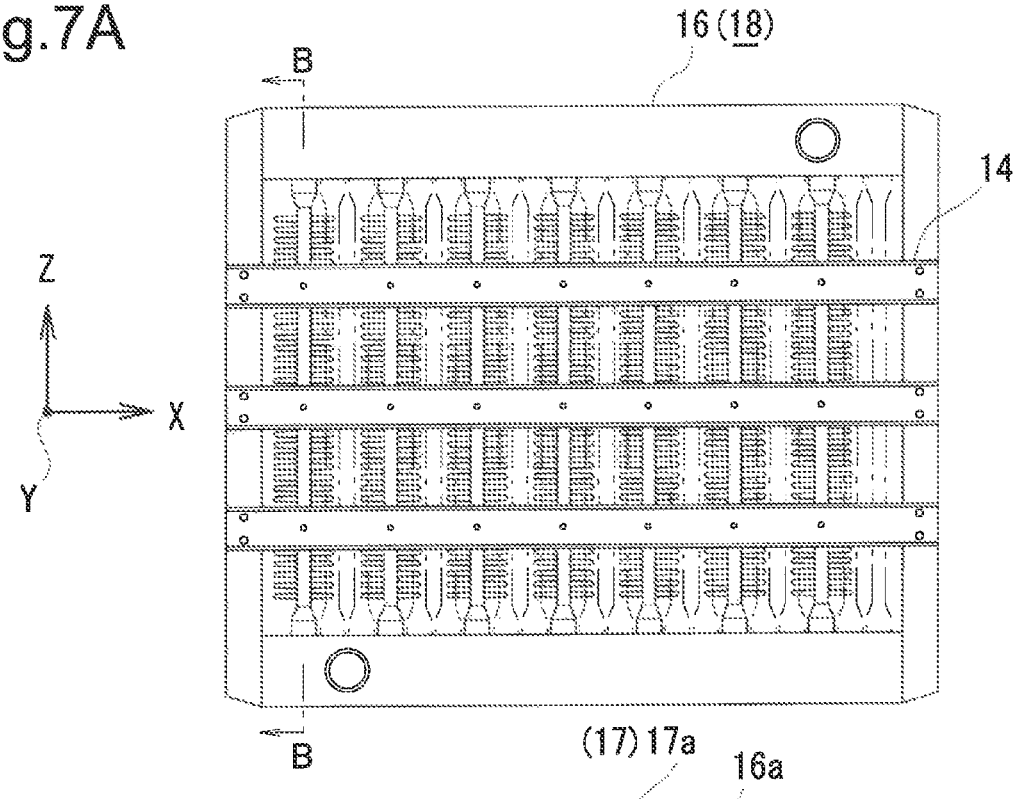
FIGS. 7A, 7B show as Fig. A a front view showing relationship between a support bracket 14 supporting the clip 12 and a heat exchanger 18, and as FIG. 7B a B-B cross-sectional view.

An aggregate in which many clips 12 and the tube element 4 are combined is sandwiched with a pair of support brackets 14 arranged on both sides in the Y direction via a support rubber 15, as shown in FIG. 5, FIGS. 6A-6C. The support bracket 14 is detachably mounted on a pair of right and left support members of the heat exchanger 18, as shown in FIG. 7A.

Figure 7B:
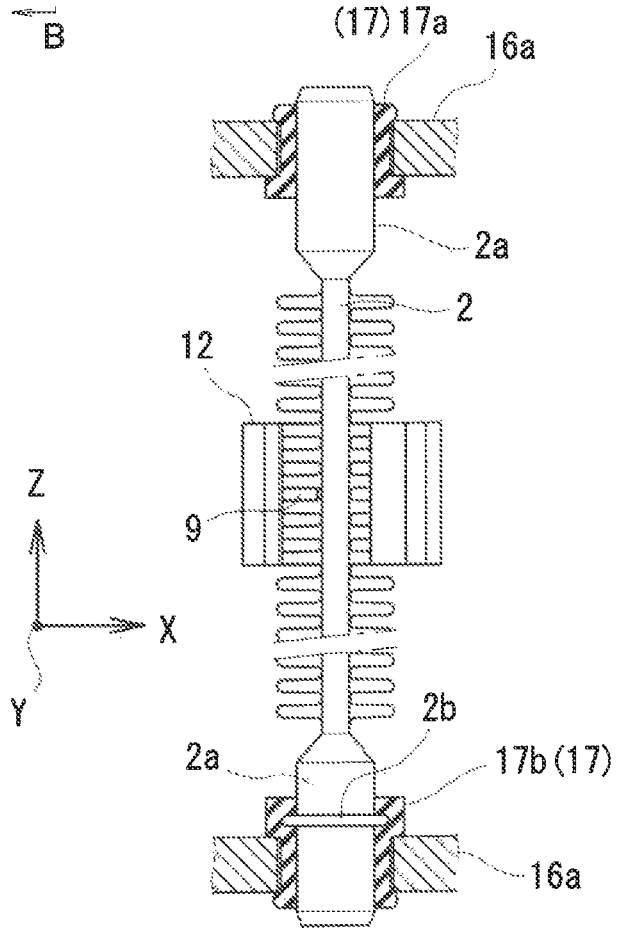

Both of upper and lower ends of the flat tube 2 of each tube element 4 have been made to be a cylindrical part 2*a* formed in a cylindrical shape, as shown in FIG. 7B. Then, upper and lower cylindrical parts 2*a* are inserted into header plates 16*a* of upper and lower tanks 16 via a mount cushion 17. These upper and lower mount cushions 17 absorb thermal strain generated in the flat tube 2.

On the lower side cylindrical part 2*a* of the flat tube 2, an annular protruding part 2*b* for preventing fall-off can be provided on the outer circumference thereof, as shown in FIG. 7(B). This annular protruding part 2*b* is fitted to the inner circumference of a lower side mount cushion 17*b* to prevent the fall-off of the flat tube 2.

In this construction, since the support rubber 15 has been fixed to the support bracket 14, a large load is applied to the lower side mount cushion 17*b* whose displacement is restricted with the annular protruding part 2*b*, if displacement in the Z-axis direction of the flat tube 2 is restrained too much with the tongue piece 9 of the clip 12.

As the result, cracks might be generated in the lower side mount cushion 17*b* to cause liquid leak.

As a means for solving the problem, a second Example will be explained based on FIG. 8 to FIG. 10.

Figure 8:
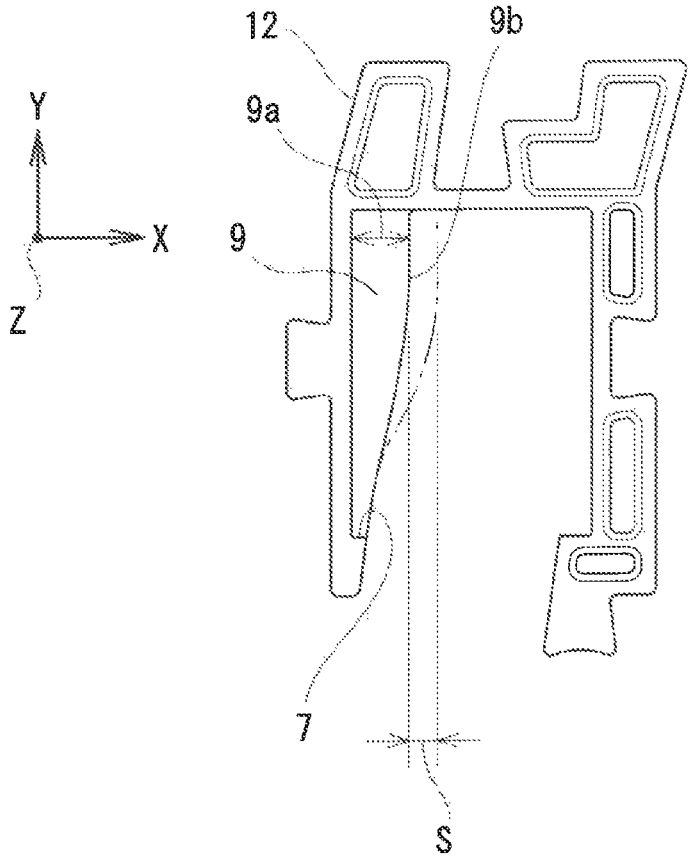
FIG. 8 shows a plan view of the clip 12 of the present invention in the second Example.
Figure 9A:
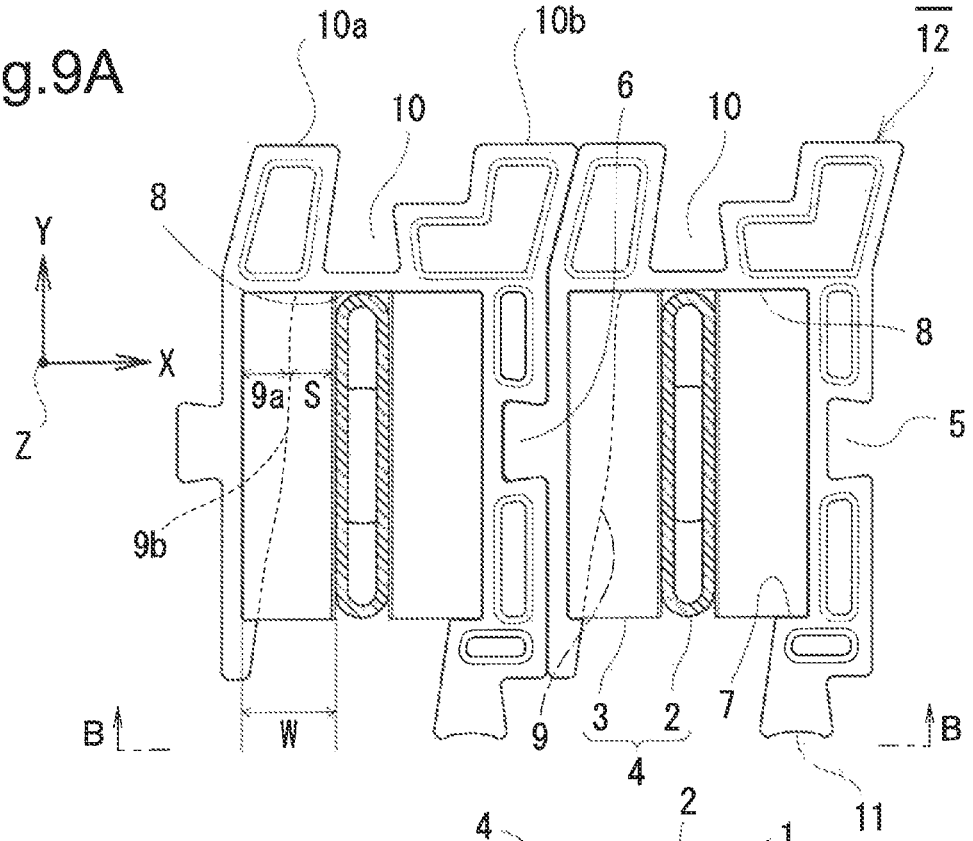
FIGS. 9A, 9B show a use explanatory view of the clip 12, in which (A) is a plan view thereof, and (B) is a view of (A) seen along the B-B arrow.
Figure 9B:
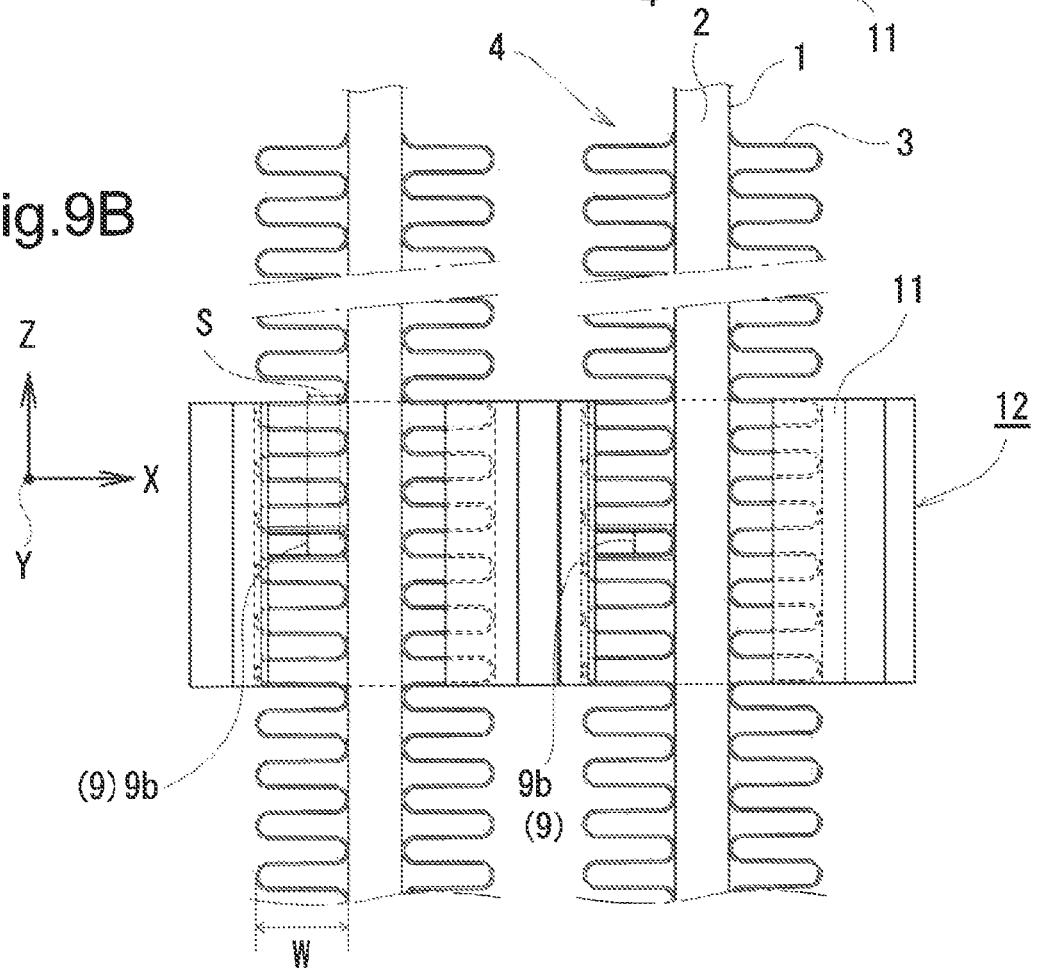

FIG. 8 shows a plan view in the second Example of the clip 12 of the present invention, and FIGS. 9A, 9B are use explanatory views of the clip 12, in which F is a plan view thereof, and FIG. 9B is a view of FIG. 9A seen along the B-B arrow.

The present inventors have found it possible to release restraint in the Z direction of the flat tube 2, by cutting off a width from the width in the first Example drawn with a dot dash line to a width 9*a* drawn with a solid line as shown in FIG. 8, and keeping the tip of a profile 9*b* thereof away from the outer surface of the flat tube 2 as described in FIG. 9B.

Figure 10:
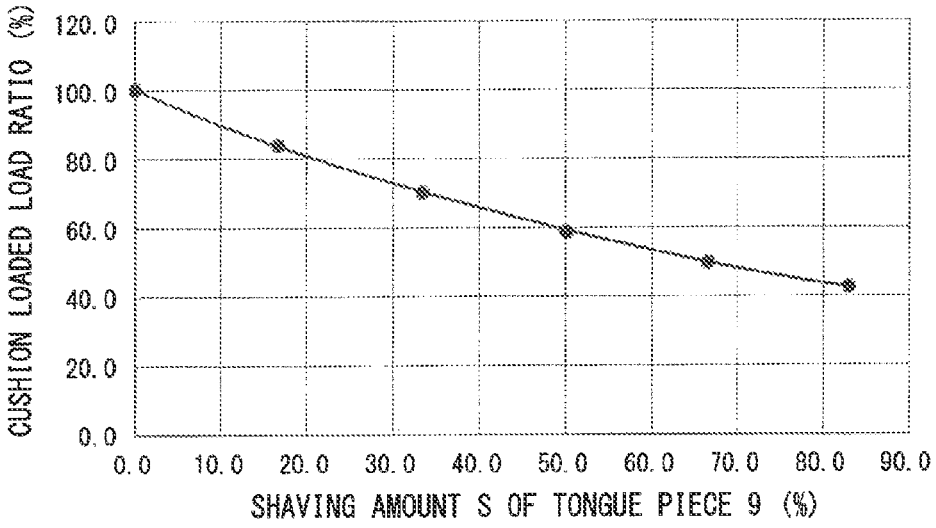
FIG. 10 shows an explanatory view showing relationship of a cushion loaded load ratio relative to a shaving amount S of the tongue piece 9 of the clip 12.
Figure 11A:
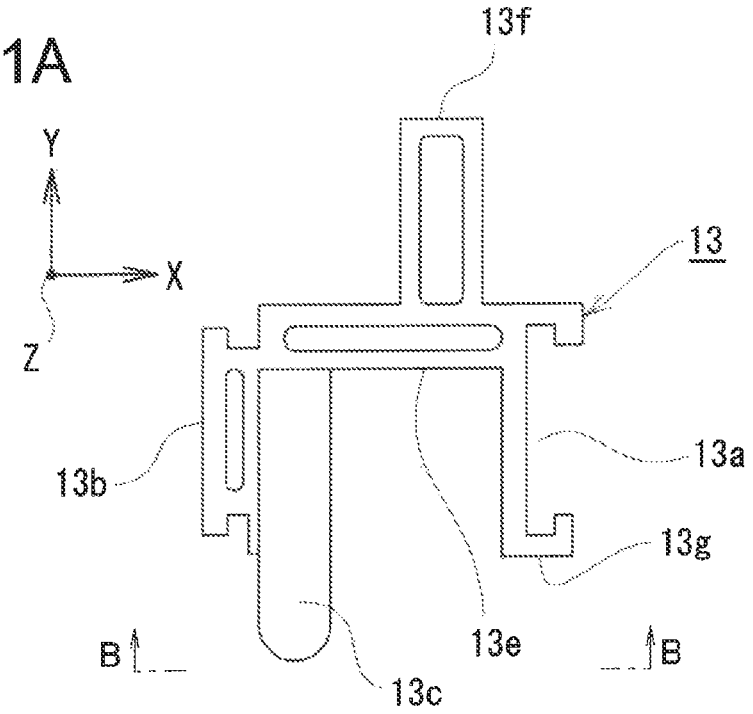
PRIOR ART Fig.11A
FIGS. 11A, 11B show as a plan view and as FIG. 11B a front view of the conventional type clip 13.
Figure 11B:
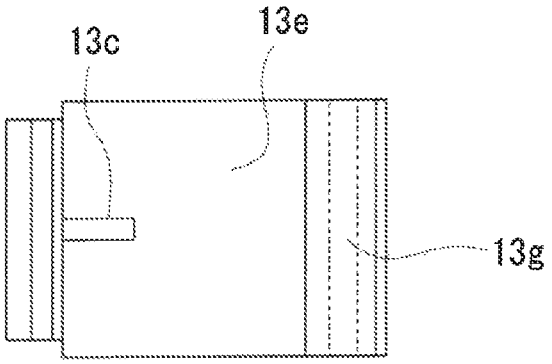
Figure 12A:
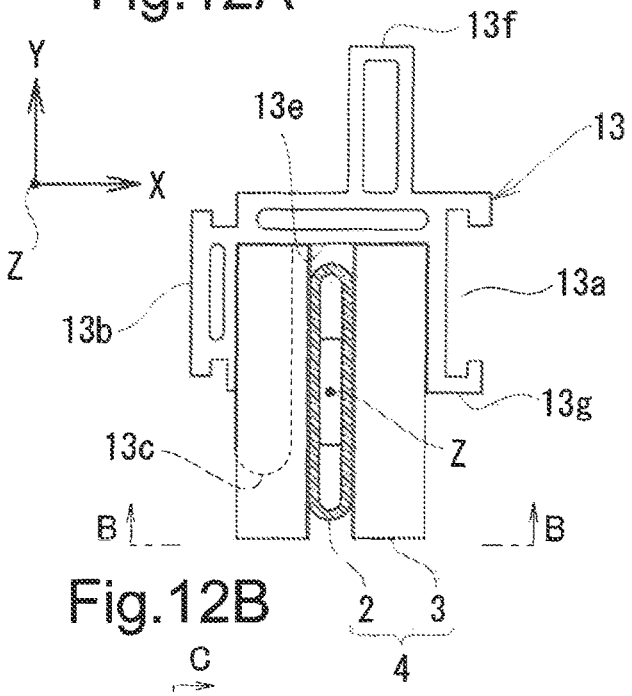
Fig.12A PRIOR ART
Figure 12C:
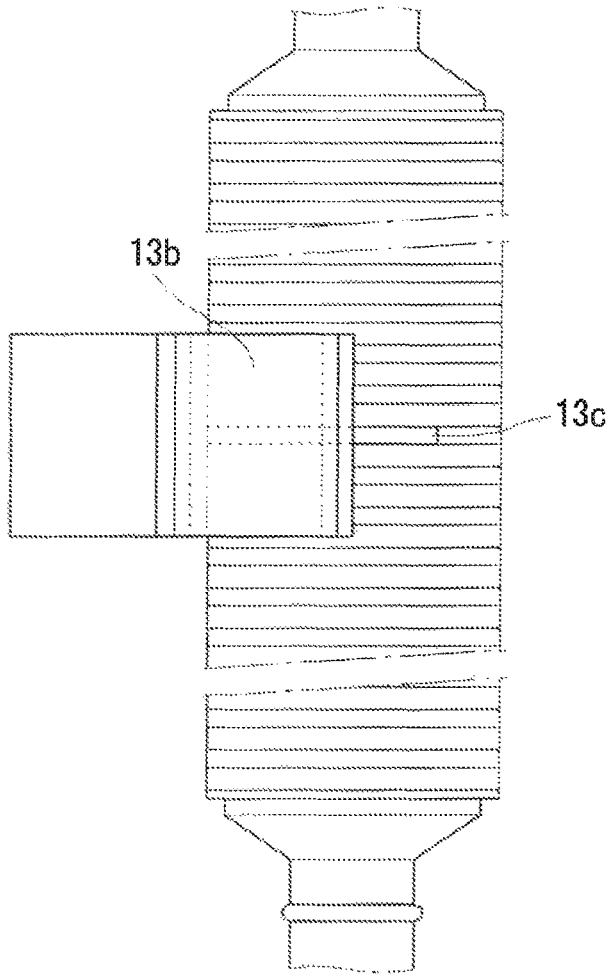
Figure 12B:
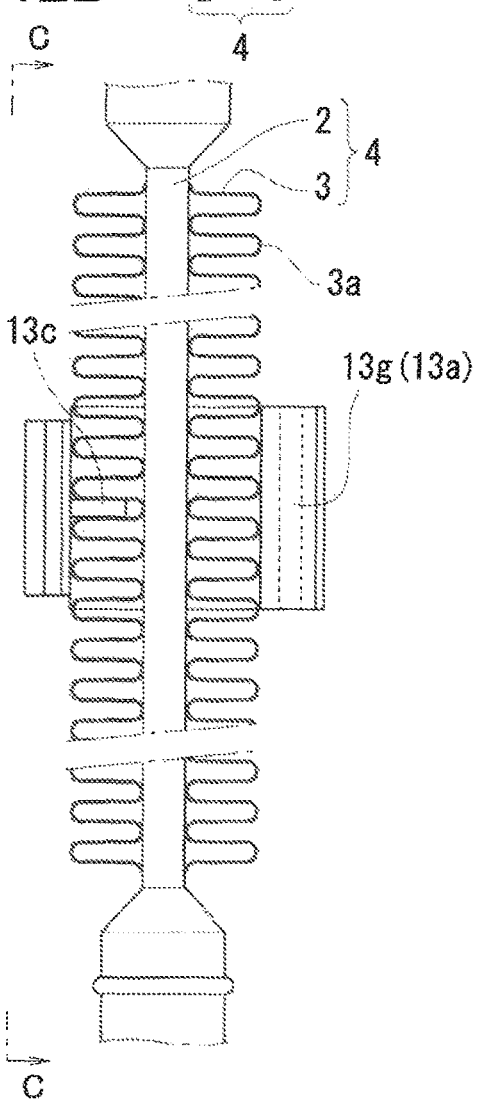
Figure 13:
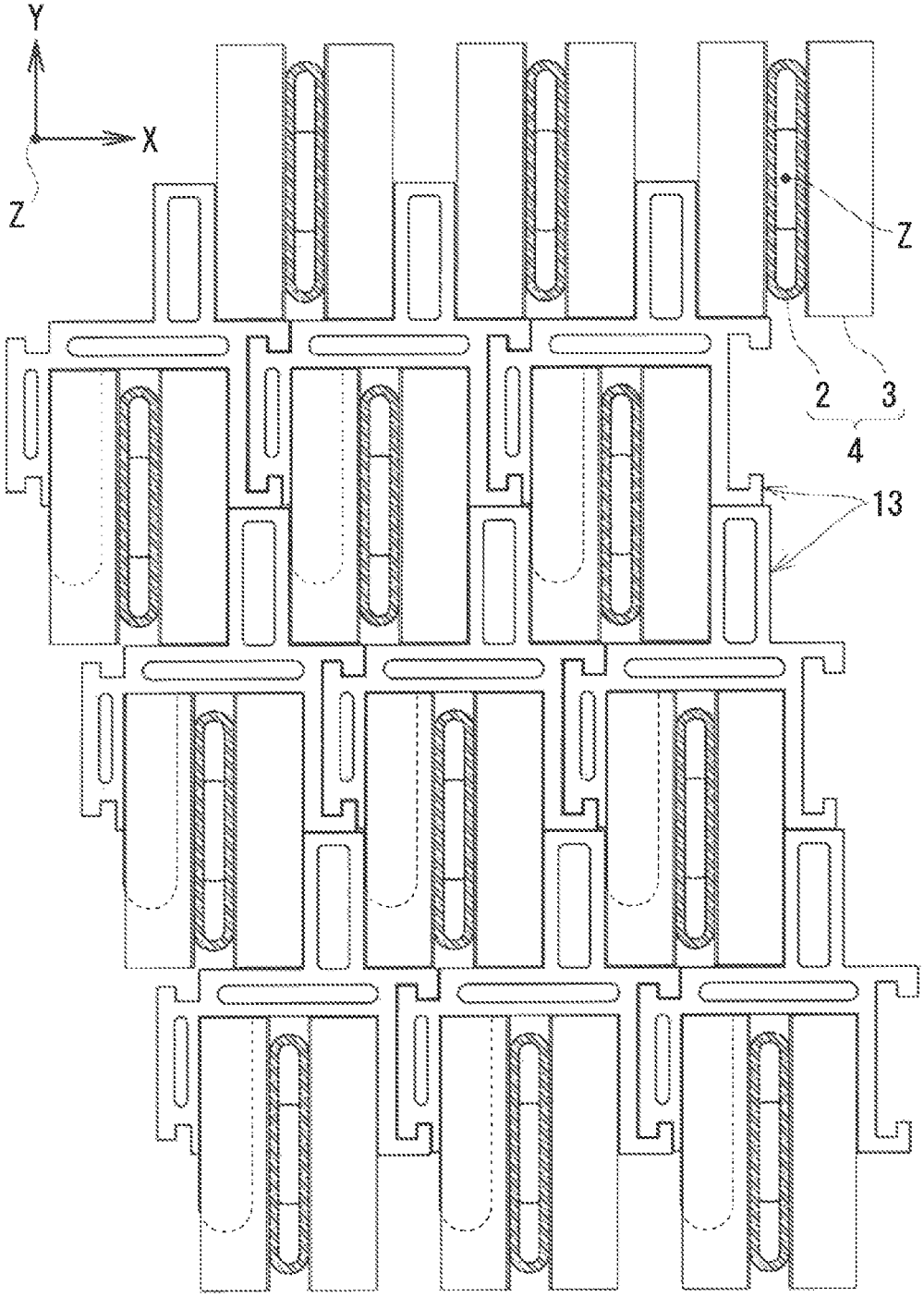
PRIOR ART Fig.13
FIG. 13 shows a plan view showing the mounting state of the many clips 13.

FIG. 10 shows an explanatory view showing the relationship of the cushion loaded load ratio relative to the shaving amount S of the tongue piece 9 of the clip 12.

The ordinate is set as the cushion loaded load ratio (%) of the lower side mount cushion 17*b*, and the abscissa is set as the shaving amount (%) of the width 9*a* of the tongue piece 9. The cushion loaded load ratio in the lower side mount cushion 17*b* of the tongue piece 9 in the first Example (in the state in which the tongue piece 9 has not been shaved) is defined as 100%, and the shaving amount S of the tongue piece 9 in the first Example (in the state in which the tongue piece 9 has not been shaved) is defined as 0.0%. Then, the correlation between both is plotted.

As FIG. 10 shows, in an instance where the maximum value of the width 9*a* in the X direction of the tongue piece 9 is set in a range from 30 to 70%, more preferably from 40 to 60% of the height W of the corrugated fin 3 (which corresponds to the shaving amount S of the tongue piece 9 in FIG. 10), the restraint in the Z direction of the corrugated fin 3 and flat tube 2 by the clip 12 is released, to thereby suppress generation of thermal stress due to the restraint.

The height W of the corrugated fin 3 corresponds to twice the amplitude of waves of the corrugated fin 3.

INDUSTRIAL APPLICABILITY

The clip of the present invention can be utilized as one holding a tube element of heat exchangers.

The invention claimed is:

1. A clip for tube element, comprising:

a flat tube having a pair of even surfaces facing each other;

a corrugated fin formed in a waveform;

a plurality of tube elements in which a bent part on one side of the wave of the corrugated fin is joined with the even surface orthogonally to an axis line Z of the flat tube wherein;

the clip for coupling these tube elements each other includes:

in an instance of defining a ridgeline direction of the bent part which is orthogonal to the axis line Z as Y, while defining a direction orthogonal to the Y and Z as X;

a first fitting part in which a groove bottom is formed in a dovetail groove shape in the Z direction on one side surface in the X direction, and a convex second fitting part that is formed on the other side surface and has a horizontal section fittable to the first fitting part;

a back surface holding part in which one side in the Y direction is opened, the part holding one end part orthogonal to a ridgeline direction of the bent part of the corrugated fin at an end edge of an inner wall surface thereof to have a hook-shaped horizontal section;

a front surface holding part with a U-shaped horizontal section that holds the other end part of the corrugated fin, on an unopened side; and a tongue piece that is formed between the back surface holding part and the front surface holding part and is inserted between neighboring waves of the corrugated fin.

2. The clip for tube element according to claim 1, wherein;

the clip for tube element is provided with a third fitting part with a groove bottom formed in a dovetail groove shape in the Z direction on a side surface of an outside in the Y direction of the front surface holding part, and a fourth fitting part that is provided in a protruding state on a side surface of an outside in the Y direction of the back surface holding part and is fittable to the third fitting part.

3. The clip for tube element according to claim 1, wherein;

width in the X direction of the tongue piece gradually enlarges from the back surface holding part toward the front surface holding part.

4. The clip for tube element according to claim 1, wherein;

the maximum value of width in the X direction of the tongue piece ranges from 30 to 70% of height of the corrugated fin.

5. The clip for tube element according to claim 2, wherein;

the third fitting part is constituted of a first protruding part that lies on a second fitting part side of an outside of the front surface holding part and protrudes in the Y direction, and a second protruding part that lies on a first fitting part side of an outside of the front surface holding part and protrudes in the Y direction; and, in a state in which the fourth fitting part of a neighboring clip has been fitted in the Y direction to the third fitting part, an end surface of the first protruding part or an end surface of the second protruding part supports one end part in a longitudinal direction of a horizontal section of the flat tube of the tube element held with the clip neighboring in the Y direction.

6. The clip for tube element according to claim 3, wherein;

the third fitting part is constituted of a first protruding part that lies on a second fitting part side of an outside of the front surface holding part and protrudes in the Y direction, and a second protruding part that lies on a first fitting part side of an outside of the front surface holding part and protrudes in the Y direction; and, in a state in which the fourth fitting part of a neighboring clip has been fitted in the Y direction to the third fitting part, an end surface of the first protruding part or an end surface of the second protruding part supports one end part in a longitudinal direction of a horizontal section of the flat tube of the tube element held with the clip neighboring in the Y direction.

7. The clip for tube element according to claim 4, wherein;

the third fitting part is constituted of a first protruding part that lies on a second fitting part side of an outside of the front surface holding part and protrudes in the Y direction, and a second protruding part that lies on a first fitting part side of an outside of the front surface holding part and protrudes in the Y direction; and, in a state in which the fourth fitting part of a neighboring clip has been fitted in the Y direction to the third fitting part, an end surface of the first protruding part or an end surface of the second protruding part supports one end part in a longitudinal direction of a horizontal section of the flat tube of the tube element held with the clip neighboring in the Y direction.

8. The clip for tube element according to claim 2, wherein;

width in the X direction of the tongue piece gradually enlarges from the back surface holding part toward the front surface holding part.

9. The clip for tube element according to claim 2, wherein;

the maximum value of width in the X direction of the tongue piece ranges from 30 to 70% of height of the corrugated fin.

10. The clip for tube element according to claim 8, wherein;

the third fitting part is constituted of a first protruding part that lies on a second fitting part side of an outside of the front surface holding part and protrudes in the Y direction, and a second protruding part that lies on a first fitting part side of an outside of the front surface holding part and protrudes in the Y direction; and, in a state in which the fourth fitting part of a neighboring clip has been fitted in the Y direction to the third fitting part, an end surface of the first protruding part or an end surface of the second protruding part supports one end part in a longitudinal direction of a horizontal section of the flat tube of the tube element held with the clip neighboring in the Y direction.

11. The clip for tube element according to claim 9, wherein;

the third fitting part is constituted of a first protruding part that lies on a second fitting part side of an outside of the front surface holding part and protrudes in the Y direction, and a second protruding part that lies on a first fitting part side of an outside of the front surface holding part and protrudes in the Y direction; and, in a state in which the fourth fitting part of a neighboring clip has been fitted in the Y direction to the third fitting part, an end surface of the first protruding part or an end surface of the second protruding part supports one end part in a longitudinal direction of a horizontal section of the flat tube of the tube element held with the clip neighboring in the Y direction.

* * * * *